US011359465B2

(12) United States Patent
Williams

(10) Patent No.: US 11,359,465 B2
(45) Date of Patent: Jun. 14, 2022

(54) SYSTEMS FOR HANGING STRUCTURES IN DOWNHOLE ENVIRONMENTS

(71) Applicant: Jeffrey Williams, Cypress, TX (US)

(72) Inventor: Jeffrey Williams, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/839,836

(22) Filed: Apr. 3, 2020

(65) Prior Publication Data

US 2021/0310339 A1 Oct. 7, 2021

(51) Int. Cl.

| | |
|---|---|
| ***E21B 43/10*** | (2006.01) |
| ***E21B 23/01*** | (2006.01) |
| ***E21B 33/04*** | (2006.01) |
| *E21B 17/07* | (2006.01) |
| *E21B 21/01* | (2006.01) |
| *E21B 17/02* | (2006.01) |
| *E21B 19/16* | (2006.01) |
| *E21B 17/08* | (2006.01) |

(52) U.S. Cl.

CPC ..... *E21B 43/106* (2013.01); *E21B 23/01* (2013.01); *E21B 33/04* (2013.01); *E21B 33/0415* (2013.01); *E21B 43/103* (2013.01); *E21B 17/02* (2013.01); *E21B 17/07* (2013.01); *E21B 17/08* (2013.01); *E21B 19/16* (2013.01); *E21B 21/019* (2020.05); *E21B 43/10* (2013.01)

(58) Field of Classification Search

CPC ..... E21B 17/02; E21B 17/07; E21B 17/08; E21B 19/16; E21B 21/019; E21B 43/10; E21B 43/106; E21B 23/01; E21B 43/103; F16L 25/021; F16L 25/14; F16L 47/16; F16L 55/165; F16L 13/168

See application file for complete search history.

(56) References Cited

U.S. PATENT DOCUMENTS 6,655,456 B1 * 12/2003 Yokley ..... E21B 23/01 166/208
8,499,844 B2 * 8/2013 Gandikota ..... E21B 33/127 166/387

(Continued)

FOREIGN PATENT DOCUMENTS

CN 209780811 U 12/2019
WO 2006038033 A1 4/2006

OTHER PUBLICATIONS

International Search Report, International Application No. PCT/US2021/023616, dated Jul. 13, 2021, Korean Intellectual Property Office; International Search Report 3 pages.

(Continued)

*Primary Examiner* — Giovanna Wright

(74) *Attorney, Agent, or Firm* — Cantor Colburn LLP

(57) ABSTRACT

Downhole hanger systems are described. The downhole hanger systems include a first structure having an outer surface, a second structure having an inner surface, wherein the first structure is disposed within the second structure, and at least one rib set is arranged on the outer surface of the first structure and configured to be engageable with the inner surface of the second structure. The at least one rib set includes a first rib having a first rib height and a second rib having a second rib height that is less than the first rib height.

19 Claims, 6 Drawing Sheets

(56) References Cited

U.S. PATENT DOCUMENTS

| | | | | |
|---|---|---|---|---|
| 2008/0110641 | A1* | 5/2008 | Howlett | E21B 43/10 166/382 |
| 2008/0210440 | A1 | 9/2008 | Stuart | |
| 2014/0174763 | A1 | 6/2014 | Zhong et al. | |
| 2015/0136417 | A1* | 5/2015 | Elliott | E21B 17/1078 166/377 |
| 2016/0090801 | A1 | 3/2016 | Hazelip et al. | |
| 2018/0202586 | A1* | 7/2018 | Larson | F16L 25/14 |
| 2019/0195030 | A1* | 6/2019 | Juarez | F16L 15/06 |

OTHER PUBLICATIONS

International Written Opinion, International Application No. PCT/US2021/023616, dated Jul. 13, 2021, Korean Intellectual Property Office; International Written Opinion 4 pages.

* cited by examiner

SYSTEMS FOR HANGING STRUCTURES IN DOWNHOLE ENVIRONMENTS

BACKGROUND

Boreholes are drilled deep into subsurface formations for many applications, such as carbon dioxide sequestration, geothermal production, and hydrocarbon exploration and production. In all of the applications, the boreholes are drilled such that they pass through or allow access to a material (e.g., a gas or fluid) contained in a formation located below the Earth's surface. Once the boreholes have been drilled, such boreholes may require gravel packing to prevent sand or other debris from being extracted from a formation during production.

Establishing and maintaining contact integrity between liner hangers and a base casing has long been one of the most problematic areas facing operators involved in downhole operations. Current liner hanger systems, e.g., mechanical liner hangers, hydraulic liner hangers, balanced cylinders liner hangers, expandable liner hangers, etc. may suffer from complex designs (e.g., including both liner-top packer and liner hanger) and, potentially, low reliability, adding additional costs during both manufacturing and maintenance (e.g., during their lifecycle).

For example, the use of expandable liner hangers has been employed. Some such expandable liner hangers include ribs on an exterior surface thereof to aid in engagement and supporting hanging loads. Such expandable tubular ribs have proven to depend on static friction forces for hanging capacity. As a result, such configurations are typically not scalable. Conventional slip design liner hangers require hardened tip(s) and very high setting forces to cause the tips to penetrate the parent casing to create a "bite" deformation for load bearing. These are complex and expensive configurations.

An additional factor impacting liner hangers is the requirement for high load capabilities. The load imposed upon the liner hanger may be exceptionally high, and when factored with other environmental conditions, can lead to problematic systems. Accordingly, there is a need for a simple and rugged downhole joining designs to connect a liner with a hanger in downhole environments.

SUMMARY

Downhole hanger systems and methods for hanging a first structure from a second structure in downhole environments are described. The downhole hanger systems include a first structure having an outer surface, a second structure having an inner surface, wherein the first structure is disposed within the second structure, and at least one rib set is arranged on the outer surface of the first structure and configured to be engageable with the inner surface of the second structure. The at least one rib set includes a first rib having a first rib height and a second rib having a second rib height that is less than the first rib height.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Disclosed are methods and systems for hanging one structure from another structure in downhole environments. In accordance with some embodiments, methods and systems for hanging a first structure (e.g., a liner) to a second structure (e.g., a casing) in an oil well or other borehole are described. In accordance with the present disclosure, the system includes a liner hanger that includes external ribs arranged to allow for a tapered or wedge-like engagement with an interior surface of a casing. In some embodiments, the tapered rib structure may be arranged in a uniform direction, and in other embodiments, an alternating directional configuration may be achieved. Advantageously, embodiments of the present disclosure provide for relatively simple hanger configurations with increased loads while reducing complexities of installation and engagement.

Figure 1:
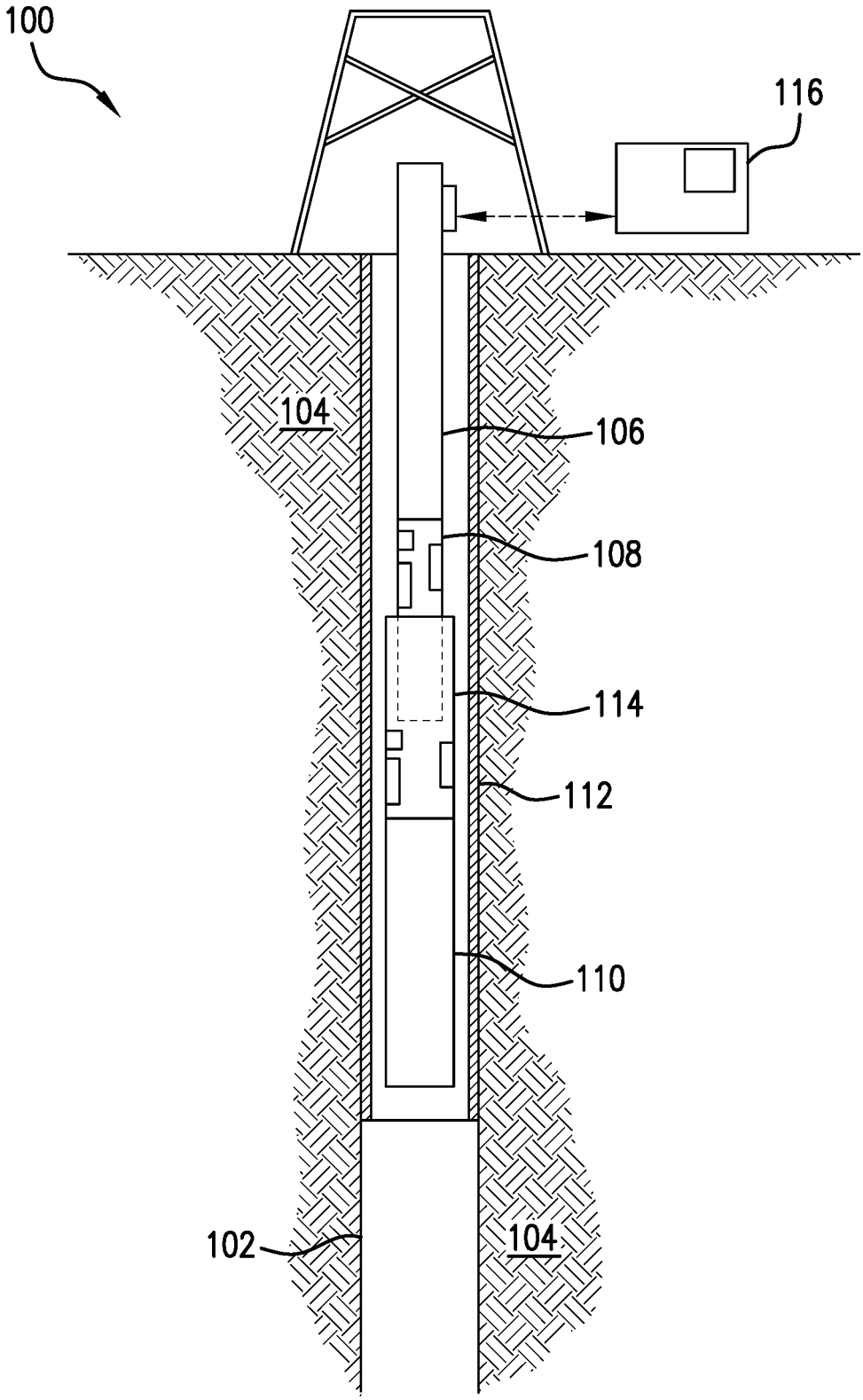
FIG. 1 depicts a downhole hanger system that can incorporate embodiments of the present disclosure.

Referring to FIG. 1, a schematic illustration of an embodiment of a system 100 for production of downhole resources (e.g., oil, gas, hydrocarbons, etc.) through a borehole 102 passing through an earth formation 104 that can employ embodiments of the present disclosure is shown. The system 100 includes a work string 106 disposed within the borehole 102. The work string 106, in some embodiments, includes a plurality of string segments or, in other embodiments, is a continuous conduit such as a coiled tube, and in some embodiments may be a drill string. As described herein, "string" refers to any structure or carrier suitable for lowering a tool or other component through a borehole, and is not limited to the structure and configuration illustrated herein. The term "carrier" as used herein means any device, device component, combination of devices, media, and/or member that may be used to convey, house, support, or otherwise facilitate the use of another device, device component, combination of devices, media, and/or member. Example, non-limiting carriers include, but are not limited to, casing pipes, wirelines, wireline sondes, slickline sondes, drop shots, downhole subs, and bottomhole assemblies.

In this illustrative embodiment, the system 100 includes a running tool 108 configured to perform a liner hanging of a liner 110 to a casing 112 that cases part of the borehole 102. The running tool 108 includes one or more tools or components to facilitate liner hanging. In some configurations, a float shoe (not shown) may be arranged at an end of the work string 106 and may be arranged proximate a toe of the borehole 102. A liner hanger 114 may be employed, as will be appreciated by those of skill in the art. The liner hanger 114 is configured to be engageable with the interior surface or inner diameter surface of the casing 112 and support and hang the liner 110 within the borehole 102. A surface unit 116 may be operably connected to and in communication with the running tool 108 to enable remote control and operation of the running tool 108 and thus hang the liner 110 from the casing 112 using the liner hanger 114.

The liner hanger, in typical configurations and operations, may be a conventional hanger that employs a slip mechanism. In such systems, mechanical slips are used to grip the inside of the casing a pre-determined distance above a casing shoe. The space between the liner hanger and the casing shoe is called the liner lap. Liner hangers can be set hydraulically, mechanically (e.g., cone deployment), or a mixture of the two. Typically, the liners are cemented back to the liner hanger.

Expandable liner hangers are beneficial to the completion of a well because they can have reduced outside diameters to mitigate running to location. Larger bypass areas allow for circulation of mud and cement more readily. Embodiments of the present disclosure are directed to expandable liner hangers that utilize progressive expansion of raised ribs or teeth to instigate higher hanging loads. With this style of hanger, larger (e.g., "Big Bore") completions can be more cost effective.

Figure 2A:
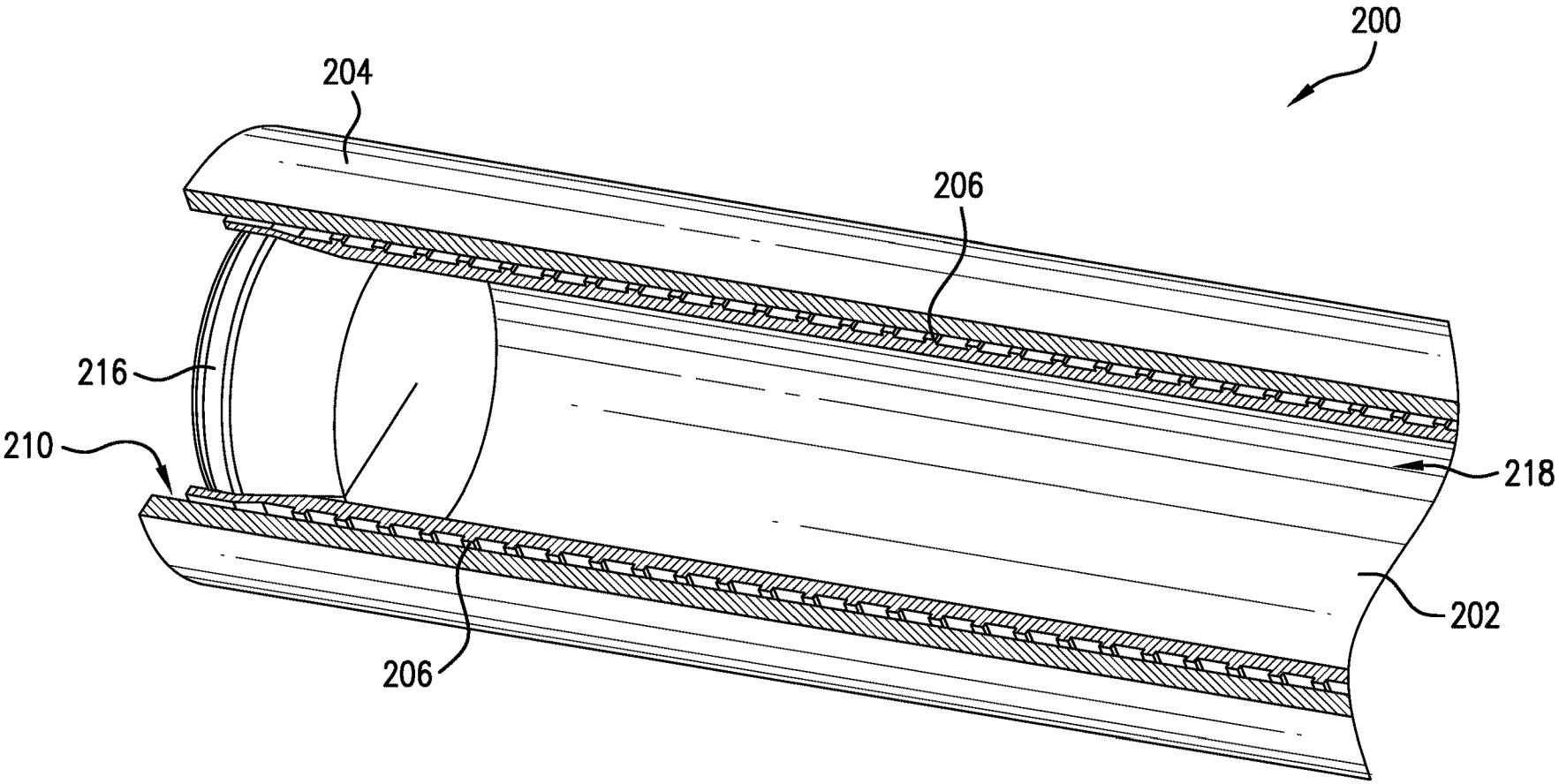
FIG. 2A is a schematic illustration of a downhole hanger system, with partial cutaway, in accordance with an embodiment of the present disclosure.
Figure 2B:
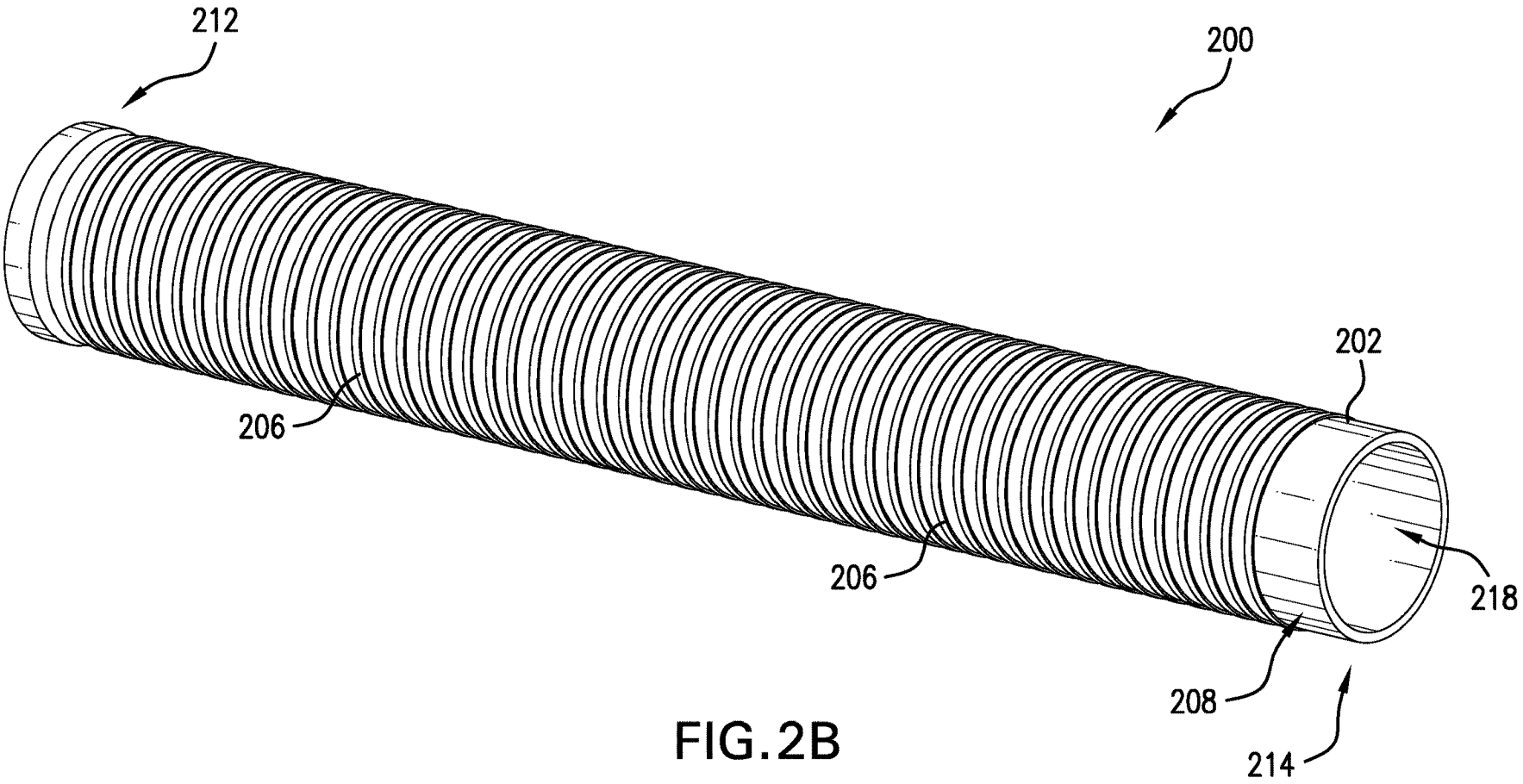
FIG. 2B is a schematic illustration of a portion of the downhole hanger system of FIG. 2A.

Turning now to FIGS. 2A-2B, schematic illustrations of a downhole hanger system 200 in accordance with an embodiment of the present disclosure are shown. FIG. 2A illustrates a first structure 202 installed within a second structure 204, illustrating a partial cut away of the downhole hanger system 200. FIG. 2B is an isometric illustration of the first structure 202.

The first structure 202 may be a liner hanger or other structure that is configured to securely engage with another structure (e.g., the second structure 204) and support loads (compressive or tensile). The second structure 204 may be a casing, a prior installed liner, a borehole wall, etc., that defines an interior bore through which the first structure 202 may pass and to which the first structure 202 can securely engage and attach to.

The first structure 202 includes a plurality of ribs 206. The ribs 206 are circumferential ribs that extend from an outer surface 208 of the first structure 202. The ribs 206, in accordance with embodiments of the present disclosure, are tiered stepped in height with respect to the distance the ribs 206 extend from the outer surface 208 of the first structure 202. The ribs 206 are configured to be engageable with an inner surface 210 of the second structure 204. The first structure 202 has a first end 212 and a second end 214, and the ribs 206 may be tiered or stepped in a manner relative to a direction from the first end 212 to the second end 214. For example, the ribs 206 may have a tallest height rib closest to the first end 212 and a shortest height rib closest to the second end 214. In some configurations, between the tallest and shortest height ribs, the intermediate ribs may be tiered or stepped such that no two adjacent ribs are the same height. In such a configurations, from the first end 212 to the second end 214, a decreasing height pattern of ribs 206 may be present. In other embodiments, the ribs may be arranged as rib sets, with each rib set providing for a tiered or stepped height pattern, with a repeating pattern of rib sets.

As shown in FIG. 2A, an activation device 216 may be pushed through an internal bore 218 of the first structure 202. As the activation device 216 moves along an axis of the first structure 202, such as from the first end 212 toward the second end 214, the activation device 216 will apply an outward radial force to cause the ribs 206 to contact and engage with the inner surface 210 of the second structure 201. Accordingly a friction engagement between the first structure 202 and the second structure 204 may be achieved. The activation device 216 illustrated in FIG. 2A is representative of a mechanical activation device, as known in the art, and such activation device is not to be limiting, as other types of activation devices may be employed without departing from the scope of the present disclosure (e.g., mechanical activation devices, hydraulic activation devices and systems, combinations thereof, etc.).

Figure 3:
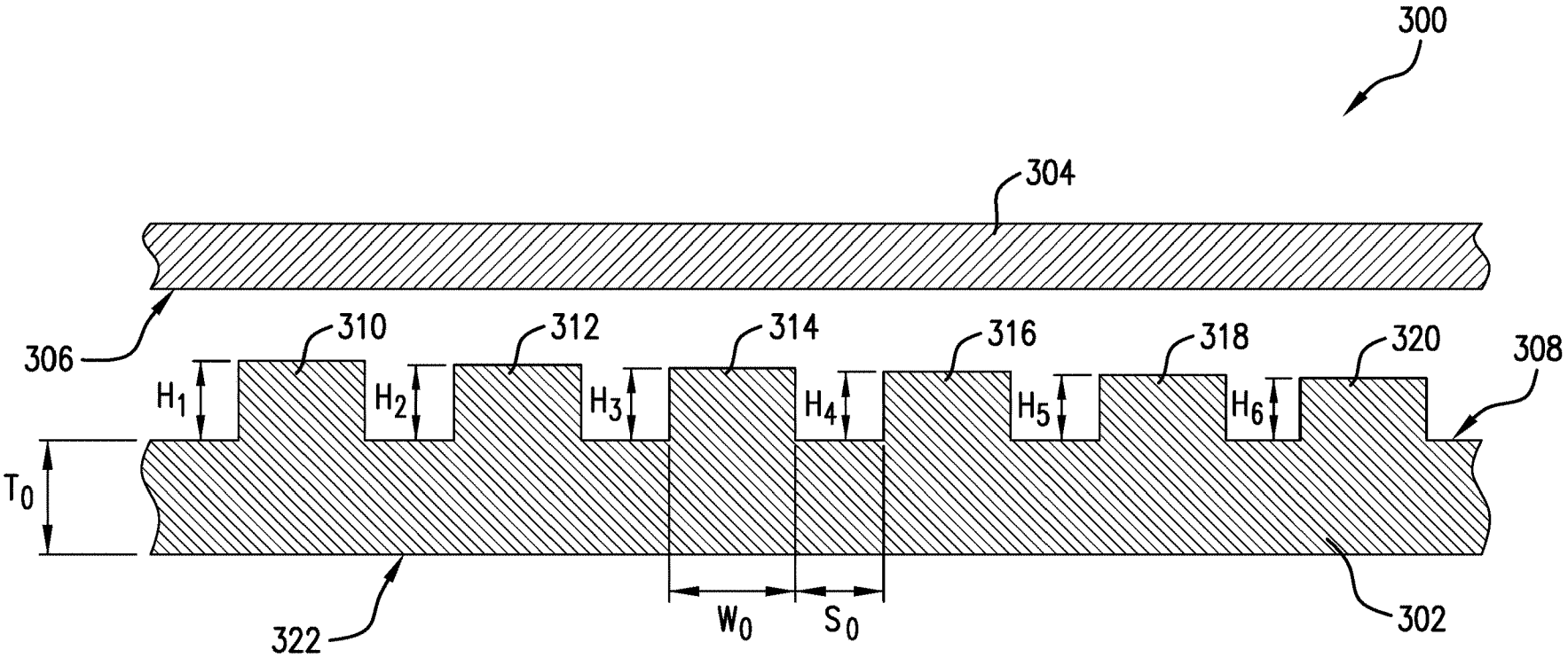
FIG. 3 is a schematic representation of a portion of a downhole hanger system in accordance with an embodiment of the present disclosure.

Turning now to FIG. 3, a schematic cross-sectional view of a downhole hanger system 300 in accordance with an embodiment of the present disclosure is shown. The downhole hanger system 300 may be similar to that shown and described above, for example. The downhole hanger system 300 is configured to enable engagement between a first structure 302 and a second structure 304. In the present illustrated configuration the first structure 302 is configured to engage with an inner surface 306 of the second structure 304. As such, in some embodiments, the first structure may be a liner hanger and the second structure may be a casing, liner, borehole wall or other structure to which the liner hanger is attached. The first structure 302, once engaged with the second structure 304, is configured to, for example, support additional components or structures (e.g., a hanging load).

The first structure 302 has an outer surface 308 from which a plurality of ribs 310, 312, 314, 316, 318, 320 extend. Each of the ribs 310, 312, 314, 316, 318, 320 is a full circumferential rib-like structure that extends from the outer surface 308 of the first structure 302. The ribs 310, 312, 314, 316, 318, 320 form a tapering configuration, with each rib being a different rib height from the outer surface 308 of the first structure 302. In this illustrative configuration, for example, a first rib 310 has a respective first rib height $H_1$, a second rib 312 has a respective second rib height $H_2$, a third rib 314 has a respective third rib height $H_3$, a fourth rib 316 has a respective fourth rib height $H_4$, a fifth rib 318 has a respective fifth rib height $H_5$, and a sixth rib 320 has a respective sixth rib height $H_6$. Each of the six rib heights $H_1$-$H_6$ in this example configuration are different, with the first rib height $H_1$ being the largest and the sixth rib height $H_6$ being the smallest, with the intermediate rib heights $H_2$-$H_5$ decreasing in height.

In one example, in operation, the first structure 302 may be positioned within the second structure 304 such that the first rib 310 is toward an uphole end of the first structure 302 and the sixth rib 320 is toward a downhole end of the first structure 302. This configuration would enable, for example, supporting or hanging of tensile loads. In alternative configurations, the first structure 302 may be positioned within the second structure 304 such that the first rib 310 is toward a downhole end of the first structure 302 and the sixth rib 320 is toward an uphole end of the first structure 302. This configuration would enable, for example, supporting compressive loads.

In the illustrative embodiment shown in FIG. 3, the ribs 310, 312, 314, 316, 318, 320 form a tiered rib set. In this configuration there are six ribs. However, in other embodiments, the tiered rib sets can include as few as two ribs, and ten or more ribs, based on the specific application and configuration. That is, the illustrative embodiment of FIG. 3 is not intended to be limiting with respect to the number of ribs.

As discussed above, each of the ribs 310, 312, 314, 316, 318, 320 has a different rib height. In one example configuration, the decrease in rib height may be a fixed amount. For example, in one non-limiting example, the first rib height $H_1$ may be 0.20 inch, the second rib height $H_2$ may be 0.19 inch, the third rib height $H_3$ may be 0.18 inch, the fourth rib height $H_4$ may be 0.17 inch, the fifth rib height $H_5$ may be 0.16 inch, and the sixth rib height $H_6$ may be 0.15 inch. In this case, each decrease in height is 5% of the maximum rib height (first rib height $H_1$). In other embodiments, the decrease may not be constant in terms of absolute dimension, but may be constant in percentage height of the preceding rib height, such that each subsequently shorter rib is decreased by about 5% of the preceding rib height. In other embodiments, the change in rib height may be decreased from any percentage ranging from about 1% to about 15% or greater. The progressive change in heights of the ribs may be defined by a linear relationship, an exponential relationship, a polynomial relationship, or other type of decreasing (or increasing) rib height. In some non-limiting configurations, the ribs may have rib heights (or at least a maximum rib height) that is based on a thickness $T_0$ of the first structure 302. The thickness $T_0$ is a material thickness of the first structure 302 between an inner surface 322 and the outer surface 308 of the first structure 302. In some such embodiments, the maximum rib height can be between 25-75% of the thickness $T_0$ of the first structure 302 from which the ribs extend.

In another embodiment, the first rib height $H_1$ may be 0.40 inch, the second rib height $H_2$ may be 0.38 inch, the third rib height $H_3$ may be 0.36 inch, the fourth rib height $H_4$ may be 0.34 inch, the fifth rib height $H_5$ may be 0.32 inch, and the sixth rib height $H_6$ may be 0.30 inch. This is another example, illustrative of linear progression, where each rib height drops by a set or fixed amount. In accordance with embodiments, each rib of a given rib set has at least two ribs with a first rib having a larger rib height than a second rib. It will be appreciated that the ribs may have any desirable height(s) with a progressive decrease or progressive increase in rib height along an exterior surface of the first structure. In accordance with some embodiments of the present disclosure, the set of ribs 310, 312, 314, 316, 318, 320 may be arranged along the outer surface 308 of the first structure with a rib spacing $S_0$ that is greater than the rib width $W_0$.

As shown in FIG. 3, each rib 310, 312, 314, 316, 318, 320 has a substantially uniform rib width $W_0$ which may be a width in an axial direction of the first structure 302 (e.g., in an uphole-downhole direction). Further, each rib 310, 312, 314, 316, 318, 320 may be evenly or equally spaced from an adjacent rib by a rib spacing $S_0$. In furtherance to the above example describing example rib heights, in such a configuration, the rib width $W_0$ may be 0.50 inch and the rib spacing $S_0$ may be 1.30 inch (it will be appreciated that FIG. 3 is not to scale or representative of any particularly spacing and/or widths). As such, in some configurations, the rib spacing $S_0$ may be greater than the rib width $W_0$. In other embodiments, the reverse may be true, where there rib width $W_0$ is greater than the rib spacing $S_0$, or in some embodiments, the rib spacing $S_0$ and the rib width $W_0$ may be equal. In another example, the rib width $W_0$ may be 1.0 inch and the rib spacing may be 2.0 inches or greater.

As noted, the various dimensions may be employed for rib height, rib separation distance, rib width, etc. For example, in accordance with some embodiments, the rib width (e.g., axial length) of may be about 0.1-0.7 inch or greater. Further, the rib spacing may range from about 100% to 300% or greater of the rib width. However, any desired rib width, rib spacing, and rib height may be used without departing from the scope of the present disclosure, and the illustrative example dimensions are merely provided for illustrative and explanatory purposes. The selected rib width, rib spacing, and rib height may be based on a space out and ability to expand the first structure. It will also be appreciated that the ribs may be arranged any desired length of the surface of the first structure and that the length of the first structure may have a desired length (in combination with the surface having the ribs) to achieve a desired hanging support, as will be appreciated by those of skill in the art.

In accordance with embodiments of the present disclosure, the rib width employed in embodiments may be wider than that typically used for mono-height ribs, thus enabling a larger surface area of contact between the first structure and the second structure. Furthermore, in some embodiments, relatively thick ribs (e.g., large rib widths) may be employed (e.g., up to 6 inches or greater). The use of wide ribs enables greater surface area coverage and area of contact between the first structure and the second structure. Further, this enables the rib sets to cover a larger surface area of the tool (e.g., larger axial length of the tool) as compared to mono-height systems.

Accordingly, embodiments of the present disclosure provided for a downhole hanger system that includes a first structure that is deployable into a second structure and to engage with the second structure. The first structure includes external stepped ribbing, and when activated and engaged forms macro-style wedge that creates a bearing shoulder that allows support of high loads. As described below, the ribbing of the present disclosure can provide for sets of ribs, and potentially multiple sets of ribs. The more rib sets that are employed, the higher the potential load capacity. Furthermore, the ribs and/or rib sets may be arranged in patterns to allow for a desired hanger configuration. In some configurations, bi-directional rib patterns (ribs or rib sets) can allow for wedging in both (uphole and downhole) directions. The first structure of the downhole hanger system (e.g., the one having the external rib structures) may be formed form steel, alloys, or other materials, as will be appreciated by those of skill in the art.

Figure 4:
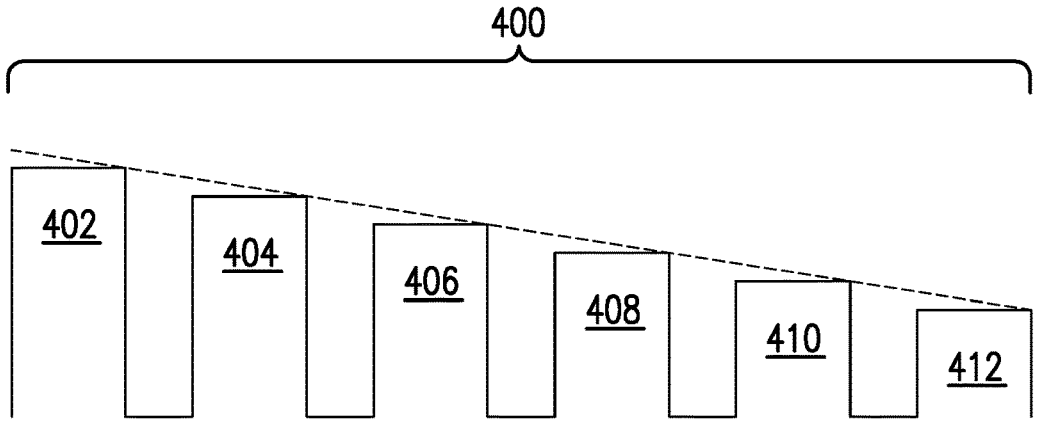
FIG. 4 is a schematic representation of a portion of a downhole hanger system in accordance with an embodiment of the present disclosure.

Turning now to FIG. 4, an example rib set 400 in accordance with an embodiment of the present disclosure is shown. The rib set 400 may be representative of a set of ribs formed or arranged on an outer surface of a first structure, such as shown and described above. In this configuration, the rib set 400 includes ribs 402, 404, 406, 408, 410, 412 arranged with a linear decreasing rib height (from left to right on the image). In this illustration, the rib set 400 includes six ribs of gradual decreasing rib height.

Figure 5:
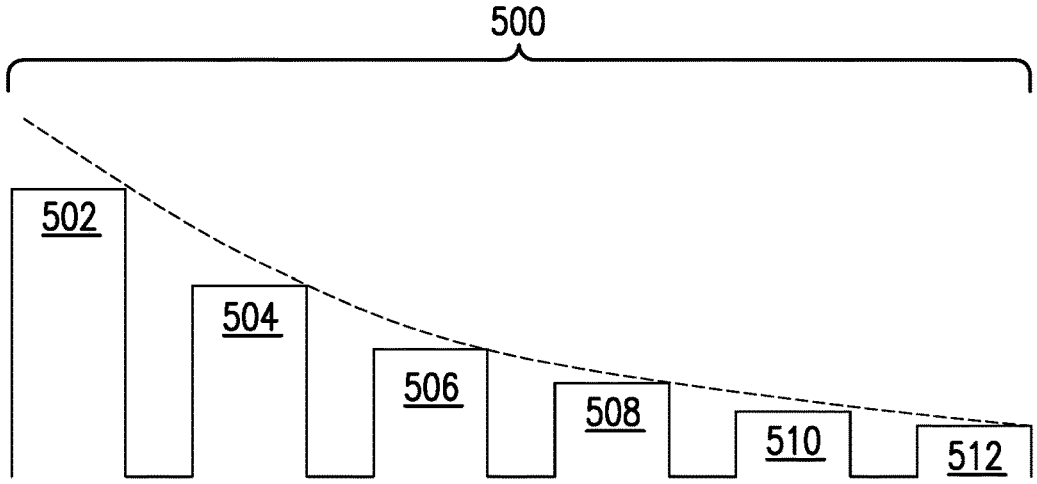
FIG. 5 is a schematic representation of a portion of a downhole hanger system in accordance with an embodiment of the present disclosure.

Turning now to FIG. 5, an example rib set 500 in accordance with an embodiment of the present disclosure is shown. The rib set 500 may be representative of a set of ribs formed or arranged on an outer surface of a first structure, such as shown and described above. In this configuration, the rib set 500 includes ribs 502, 504, 506, 508, 510, 512 arranged with a polynomial decreasing rib height (from left to right on the image). In this illustration, the rib set 500 includes six ribs of gradual decreasing rib height.

Figure 6:
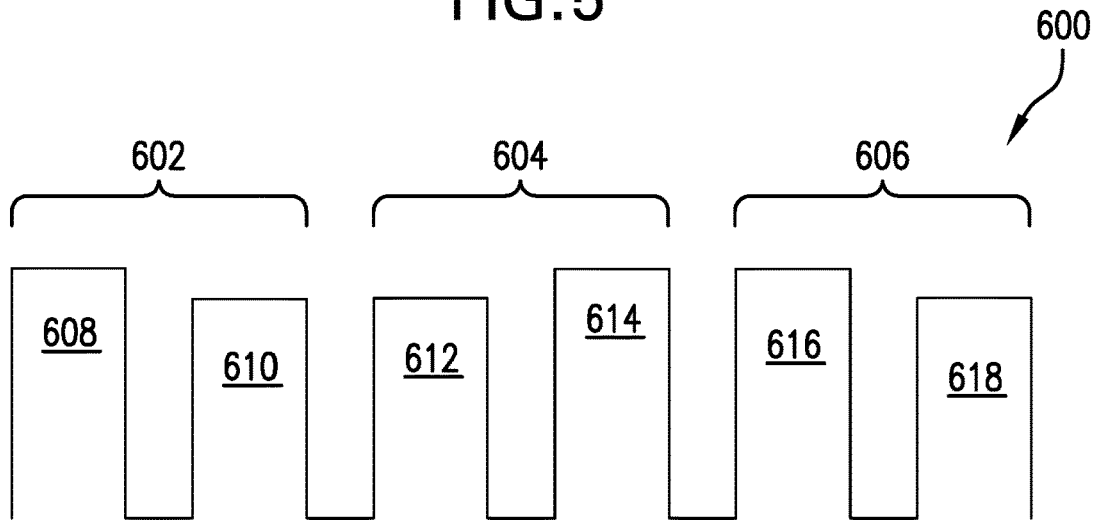
FIG. 6 is a schematic representation of a portion of a downhole hanger system in accordance with an embodiment of the present disclosure.

Turning now to FIG. 6, an example rib pattern 600 in accordance with an embodiment of the present disclosure is shown. The rib pattern 600 includes a plurality of rib sets 602, 604, 606. A first rib set 602 includes a respective first rib 608 and a respective second rib 610. In this configuration, the first rib set 602 includes a decreasing rib height, with the first rib 608 of the first rib set 602 being taller than the second rib 610 of the first rib set 602. A second rib set 604 includes a respective first rib 612 and a respective second rib 614. In this configuration, the second rib set 604 includes an increasing rib height, with the first rib 612 of the second rib set 614 being shorter than the second rib 614 of the second rib set 602. A third rib set 606 includes a respective first rib 616 and a respective second rib 618. In this configuration, the third rib set 606 includes a decreasing rib height, with the first rib 616 of the third rib set 606 being taller than the second rib 618 of the second rib set 606. In this illustrative embodiment, each rib set 602, 604, 606 includes only two ribs of different rib height. It will be appreciated, however, that a rib pattern in accordance with the present disclosure can include any number of rib sets, and any number of ribs within each respective rib set, with the same or different number of ribs in each rib set of the rib patter. For example, in one non-limiting embodiment, a rib pattern can include an alternating pattern of decreasing height rib sets with increasing height rib sets, with the rib sets of decreasing rib height having four or more ribs in each rib set and the rib sets of increasing rib height having only two or three ribs in each rib set. Those of skill in the art will appreciate that any number or configuration of ribs and rib sets may be employed without departing from the scope of the present disclosure.

Figure 7:
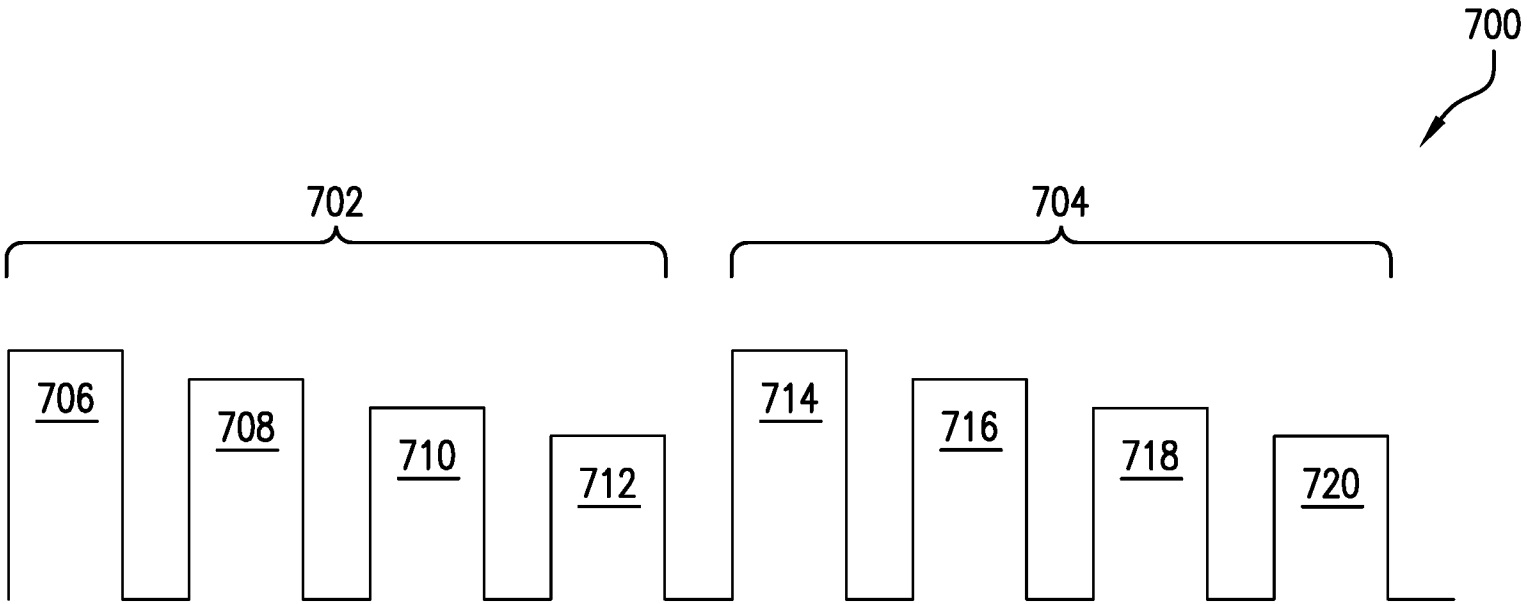
FIG. 7 is a schematic representation of a portion of a downhole hanger system in accordance with an embodiment of the present disclosure.

Turning now to FIG. 7, an example rib pattern 700 in accordance with an embodiment of the present disclosure is shown. The rib pattern 700 includes a plurality of rib sets 702, 704. A first rib set 702 includes respective ribs 706, 708, 710, 712 of decreasing rib height. A second rib set 704 includes respective ribs 714, 716, 718, 720 of decreasing rib height. In this illustrative configuration, each rib set 702, 704 of the rib pattern 700 include four ribs of decreasing rib height.

It will be appreciated that the above illustrative embodiments are examples and that other configurations may be employed without departing from the scope of the present disclosure. Embodiments of the present disclosure are directed to progressive or tiered rib structures on an exterior or outer surface of a first structure that is disposed within and engaged to an inner surface of a second structure. When actuated, the ribs expand radially outward and into the second structure. The tiered or stepped rib height of the ribs allows for staggered or "progressive" deformations of the second structure. In some configurations, multiple sets can be useful in making minute axial load bearing surfaces for increased capacities of "hanging" (e.g., tensile) or "hold-down" (e.g., compressive) loads. It will be appreciated that the sets of ribs may be scalable based on desired overall length, force, and load desired.

Although ribbed structures have been previously employed for liner hangers and similar structures, such ribs are of uniform or mono-height. Mono-height designed expandable tubular ribs have proven to mostly depend on static friction forces for hanging capacity. In turn, that style is not scalable. Conventional slip designs require a hardened tip and much higher setting forces to penetrate the parent casing to create a more micro style "bite" deformation for load bearing. These are more complex configurations and considerably more expensive. Utilizing macro deformations in the elastic regime of the parent casing, embodiments of the present disclosure enable activation without the use of any extra preparations of the second structure (e.g., hardening). Embodiments of the present disclosure are robust because the rib widths are relatively wider than typical rib configurations and are less sensitive to well damage or transport. Furthermore, advantageously, embodiments of the present disclosure can eliminate the need for an elastomer to seal or hang from contact pressure.

The above described embodiments, and variations thereon, utilize a relatively simplistic tubular expandable that enables "macro" style deformations over a relatively long length to achieve similar success of more complex conventional liner hangers. Conventional slip design requires higher radial loads to "set" the slips and maintain full support underneath while also a locking mechanism to lock axial slip movement. Embodiments described herein require no such additional setting load and force, and thus are easier to install and deploy than prior systems.

While embodiments described herein have been described with reference to specific figures, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed, but that the present disclosure will include all embodiments falling within the scope of the appended claims or the following description of possible embodiments.

Embodiment 1: A downhole hanger system comprising: a first structure having an outer surface; a second structure having an inner surface, wherein the first structure is disposed within the second structure; and at least one rib set arranged on the outer surface of the first structure and configured to be engageable with the inner surface of the second structure, wherein the at least one rib set comprises a first rib having a first rib height and a second rib having a second rib height that is less than the first rib height.

Embodiment 2: The downhole hanger system of any preceding embodiment, wherein the first rib height is between 25% and 75% of a thickness of the first structure, wherein the thickness of the first structure is defined by a material thickness between an inner surface of the first structure and the outer surface of the first structure.

Embodiment 3: The downhole hanger system of any preceding embodiment, wherein a rib spacing between adjacent ribs is greater than a rib width in an axial direction of the first structure.

Embodiment 4: The downhole hanger system of any preceding embodiment, wherein the first structure is a liner hanger and the second structure is a casing.

Embodiment 5: The downhole hanger system of any preceding embodiment, wherein the at least one rib set comprises a third rib and a fourth rib, wherein the third rib has a third rib height that is less than the second rib height and the fourth rib has a fourth rib height that is less than the third rib height.

Embodiment 6: The downhole hanger system of any preceding embodiment, wherein the ribs are arranged in an decreasing order such that the first rib is closer to a first end of the first structure, the second rib is closer to a second end of the first structure relative to the first rib, the third rib is closer to the second end of the first structure relative to the second rib, and the fourth rib is closer to the second end of the first structure relative to the third rib.

Embodiment 7: The downhole hanger system of any preceding embodiment, wherein the at least one rib set comprises a third rib, a fourth rib, a fifth rib, and a sixth rib, wherein the third rib has a third rib height that is less than the second rib height, the fourth rib has a fourth rib height that is less than the third rib height, the fifth rib has a fifth rib height that is less than the fourth rib height, and the sixth rib has a sixth rib height that is less than the fifth rib height.

Embodiment 8: The downhole hanger system of any preceding embodiment, wherein the difference in rib height between each adjacent rib is equal.

Embodiment 9: The downhole hanger system of any preceding embodiment, wherein difference in rib height between each adjacent rib is 0.01 inch.

Embodiment 10: The downhole hanger system of any preceding embodiment, wherein the rib set includes at least one additional rib, wherein the at least one additional rib has a shorter rib height than the second rib.

Embodiment 11: The downhole hanger system of any preceding embodiment, wherein the rib set is defined by a linear relationship of changes in rib height.

Embodiment 12: The downhole hanger system of any preceding embodiment, wherein the rib set is defined by a polynomial relationship of changes in rib height.

Embodiment 13: The downhole hanger system of any preceding embodiment, further comprising an activation device configured to expand the first structure into engagement with the second structure.

Embodiment 14: The downhole hanger system of any preceding embodiment, wherein the activation device is a mechanical device.

Embodiment 15: The downhole hanger system of any preceding embodiment, wherein the activation device is a hydraulic device.

Embodiment 16: The downhole hanger system of any preceding embodiment, further comprising at least one additional rib set, wherein the first structure has a first end and a second end, wherein the at least one rib set and the at least one additional rib set are arranged in a rib pattern, wherein the at least one rib set is arranged with a decreasing rib height in a direction from the first end toward the second end and the at least one additional rib set is arranged with an increasing rib height in a direction from the first end toward the second end.

Embodiment 17: The downhole hanger system of any preceding embodiment, wherein the at least one rib set is part of a rib pattern that comprises a plurality of rib sets, wherein each rib set of the plurality of rib sets comprises at least two ribs of differing rib height.

Embodiment 18: The downhole hanger system of any preceding embodiment, wherein the first rib height is 0.20 inch and the second rib height is 0.19 inch.

Embodiment 19: The downhole hanger system of any preceding embodiment, wherein the first rib is separated from the second rib by a rib spacing of 1.30 inch in an axial direction along the first structure.

Embodiment 20: The downhole hanger system of any preceding embodiment, wherein each of the first rib and the second rib have a rib width of 0.50 inch in an axial direction along the first structure.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed:

1. A downhole hanger system comprising:

a first structure having an outer surface;

a second structure having an inner surface, wherein the first structure is disposed within the second structure; and at least one rib set arranged on the outer surface of the first structure and configured to be engageable with the inner surface of the second structure, wherein the at least one rib set comprises a first rib having a first rib height and a second rib having a second rib height that is less than the first rib height, wherein each of the first rib and the second rib are circumferential ribs separated by an axial space, and the first and second ribs define a wedge-shape on the outer surface of the first structure to form a friction engagement with the second structure, wherein the rib set includes at least one additional rib, wherein the at least one additional rib has a shorter rib height than the second rib.

2. The downhole hanger system of claim 1, wherein the first rib height is between 25% and 75% of a thickness of the first structure, wherein the thickness of the first structure is defined by a material thickness between an inner surface of the first structure and the outer surface of the first structure.

3. The downhole hanger system of claim 1, wherein a rib spacing between adjacent ribs is greater than a rib width in an axial direction of the first structure.

4. The downhole hanger system of claim 1, wherein the first structure is a liner hanger and the second structure is a casing.

5. The downhole hanger system of claim 1, wherein the at least one rib set comprises a third rib, a fourth rib, a fifth rib, and a sixth rib, wherein the third rib has a third rib height that is less than the second rib height, the fourth rib has a fourth rib height that is less than the third rib height, the fifth rib has a fifth rib height that is less than the fourth rib height, and the sixth rib has a sixth rib height that is less than the fifth rib height.

6. The downhole hanger system of claim 5, wherein a difference in rib height between each adjacent rib is equal.

7. The downhole hanger system of claim 5, wherein a difference in rib height between each adjacent rib is 0.01 inch.

8. The downhole hanger system of claim 1, wherein the rib set is defined by a linear relationship of changes in rib height.

9. The downhole hanger system of claim 1, wherein the rib set is defined by a polynomial relationship of changes in rib height.

10. The downhole hanger system of claim 1, further comprising an activation device configured to expand the first structure into engagement with the second structure.

11. The downhole hanger system of claim 10, wherein the activation device is a mechanical device.

12. The downhole hanger system of claim 10, wherein the activation device is a hydraulic device.

13. The downhole hanger system of claim 1, wherein the at least one rib set is part of a rib pattern that comprises a plurality of rib sets, wherein each rib set of the plurality of rib sets comprises at least two ribs of differing rib height.

14. The downhole hanger system of claim 1, wherein the first rib height is 0.20 inch and the second rib height is 0.19 inch.

15. The downhole hanger system of claim 1, wherein the first rib is separated from the second rib by a rib spacing of 1.30 inch in an axial direction along the first structure.

16. The downhole hanger system of claim 1, wherein each of the first rib and the second rib have a rib width of 0.50 inch in an axial direction along the first structure.

17. A downhole hanger system comprising:

a first structure having an outer surface;

a second structure having an inner surface, wherein the first structure is disposed within the second structure; and at least one rib set arranged on the outer surface of the first structure and configured to be engageable with the inner surface of the second structure, wherein the at least one rib set comprises a first rib having a first rib height and a second rib having a second rib height that is less than the first rib height, wherein each of the first rib and the second rib are circumferential ribs separated by an axial space, and the first and second ribs define a wedge-shape on the outer surface of the first structure to form a friction engagement with the second structure, wherein the at least one rib set comprises a third rib and a fourth rib, wherein the third rib has a third rib height that is less than the second rib height and the fourth rib has a fourth rib height that is less than the third rib height.

18. The downhole hanger system of claim 17, wherein the ribs are arranged in a decreasing order such that the first rib is closer to a first end of the first structure, the second rib is closer to a second end of the first structure relative to the first rib, the third rib is closer to the second end of the first structure relative to the second rib, and the fourth rib is closer to the second end of the first structure relative to the third rib.

19. A downhole hanger system comprising:

a first structure having an outer surface;

a second structure having an inner surface, wherein the first structure is disposed within the second structure; and at least one rib set arranged on the outer surface of the first structure and configured to be engageable with the inner surface of the second structure, wherein the at least one rib set comprises a first rib having a first rib height and a second rib having a second rib height that is less than the first rib height, wherein each of the first rib and the second rib are circumferential ribs separated by an axial space, and the first and second ribs define a wedge-shape on the outer surface of the first structure to form a friction engagement with the second structure; and at least one additional rib set, wherein the first structure has a first end and a second end, wherein the at least one rib set and the at least one additional rib set are arranged in a rib pattern, wherein the at least one rib set is arranged with a decreasing rib height in a direction from the first end toward the second end and the at least one additional rib set is arranged with an increasing rib height in a direction from the first end toward the second end.

* * * * *